US011472020B2

(12) United States Patent
Adams et al.

(10) Patent No.: US 11,472,020 B2
(45) Date of Patent: Oct. 18, 2022

(54) UTILITY KNIFE BLADE HOLDER FOR TOOL CONTAINER SYSTEM

(71) Applicant: Stanley Black & Decker, Inc., New Britain, CT (US)

(72) Inventors: John Kenneth Adams, Hamden, CT (US); Gregory Tropea, Berlin, CT (US); Austin Charles Allessio, New Britain, CT (US); Aaron Jonathan Jones, Middletown, CT (US); Ralf Strauss, Stanley, NC (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 17/150,335

(22) Filed: Jan. 15, 2021

(65) Prior Publication Data

US 2022/0226981 A1 Jul. 21, 2022

(51) Int. Cl.

| | |
|---|---|
| ***B25H 3/02*** | (2006.01) |
| ***B65D 21/02*** | (2006.01) |
| ***B26B 9/00*** | (2006.01) |
| ***B65D 83/10*** | (2006.01) |

(52) U.S. Cl.

CPC ..... *B25H 3/02* (2013.01); *B65D 21/0204* (2013.01); *B26B 9/00* (2013.01); *B65D 83/10* (2013.01)

(58) Field of Classification Search

CPC ..... B65D 83/10; B25H 3/02; B26B 9/00

USPC ..... 206/354; 220/23.89, 23.87

See application file for complete search history.

(56) References Cited

U.S. PATENT DOCUMENTS

| | | | |
|---|---|---|---|
| 1,915,834 | A | 6/1933 | Muros |
| 2,351,442 | A | 6/1944 | Merki |
| 3,650,433 | A | 3/1972 | Robertson |
| 4,681,223 | A | 7/1987 | Roberts |
| 5,251,783 | A | 10/1993 | Gringer |

(Continued)

FOREIGN PATENT DOCUMENTS

| | | | |
|---|---|---|---|
| GB | 675813 | A | 7/1952 |
| GB | 848903 | A | 9/1960 |
| JP | 2006075188 | A | 3/2006 |

OTHER PUBLICATIONS

Extended European Search Report, dated Jun. 3, 2022, in related EP application No. 22151316.1-1017.

*Primary Examiner* — Rafael A Ortiz
*Assistant Examiner* — Sanjidul Islam
(74) *Attorney, Agent, or Firm* — Gabriel A. Haboubi

(57) ABSTRACT

In one embodiment, a tool container system includes a container with base and cover pivotably attached by a hinge, base and cover locking members, and a latch moveable between unlatched and latched positions to allow or prevent movement of the cover relative to the base. The system also includes a utility knife blade retainer configured to be received in and held by the container, the retainer configured to define a generally trapezoidal shape and contact multiple faces of blades received therein. The retainer comprises an engagement feature to engage with the container to limit movement of the retainer. In another embodiment, a knife blade retainer is configured to be received in a container. The retainer includes a generally trapezoidal shape defined therein to contact multiple faces of a trapezoidal shape of blades received therein. An engagement feature engages with the container to limit movement of the retainer within the container.

16 Claims, 8 Drawing Sheets

(56) References Cited

U.S. PATENT DOCUMENTS

| | | | | |
|---|---|---|---|---|
| 5,890,613 | A * | 4/1999 | Williams | A45C 7/0045 220/23.4 |
| 7,413,078 | B2 * | 8/2008 | Fischer | A45D 27/225 206/354 |
| 9,296,548 | B2 | 3/2016 | Schekalla | |
| 2008/0035510 | A1 * | 2/2008 | Brunson | B25H 3/021 206/373 |
| 2008/0099358 | A1 | 5/2008 | Bell et al. | |
| 2009/0288971 | A1 | 11/2009 | Webb et al. | |
| 2012/0228290 | A1 * | 9/2012 | Conti | E05B 73/0023 220/23.89 |
| 2014/0263393 | A1 * | 9/2014 | Garavaglia | B65D 83/10 221/133 |
| 2015/0349577 | A1 | 12/2015 | Breitenbach et al. | |
| 2017/0081109 | A1 | 3/2017 | Garavaglia et al. | |
| 2020/0180140 | A1 | 6/2020 | Brocket et al. | |

* cited by examiner

UTILITY KNIFE BLADE HOLDER FOR TOOL CONTAINER SYSTEM

TECHNICAL FIELD

This application relates to tool containers and a tool container system for holding tools and tool accessories.

BACKGROUND

This section provides background information related to the present disclosure which is not necessarily prior art. Tool accessory containers and tool container systems may be configured for holding tools and tool accessories (e.g., screwdriver bits) within. One such tool container system is disclosed in U.S. Pat. No. 10,603,783, incorporated by reference herein in its entirety. In some tool container systems, the tools or the accessories are held loosely within the containers, which may permit shifting of the contained products during transport.

SUMMARY

According to an embodiment, a tool container system includes a tool container having a base, a cover pivotably attached to the base by a hinge portion, a base locking member coupled to the base, a cover locking member coupled to the cover, and a latch coupled to the base and moveable between an unlatched position in which the cover is movable relative to the base between a closed position and an open position, and a latched position in which the latch engages the cover locking member and the cover is locked to the base in the closed position. The system also includes a utility knife blade retainer configured to be received in and held by the tool container, the utility knife blade retainer configured to define a generally trapezoidal shape and contact multiple faces of a trapezoidal shape of utility knife blades received in the utility knife blade retainer. The utility knife blade retainer comprises an engagement feature configured to engage with the tool container to limit movement of the utility knife blade retainer within the tool container.

According to another embodiment, a utility knife blade retainer is configured to be received in and held by a tool container. The utility knife blade retainer includes a generally trapezoidal shape defined in the utility knife blade retainer configured to contact multiple faces of a trapezoidal shape of utility knife blades received in the utility knife blade retainer. An engagement feature is configured to engage with the tool container to limit movement of the utility knife blade retainer within the tool container.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

As noted above some storage containers, such as that disclosed in U.S. Pat. No. 10,603,783 are configured to hold tools and tool accessories. As this disclosure may improve upon such containers, FIGS. 1-3 illustrates examples of such containers so that they may be described in greater detail alongside improvements thereof herein.

Figure 1:
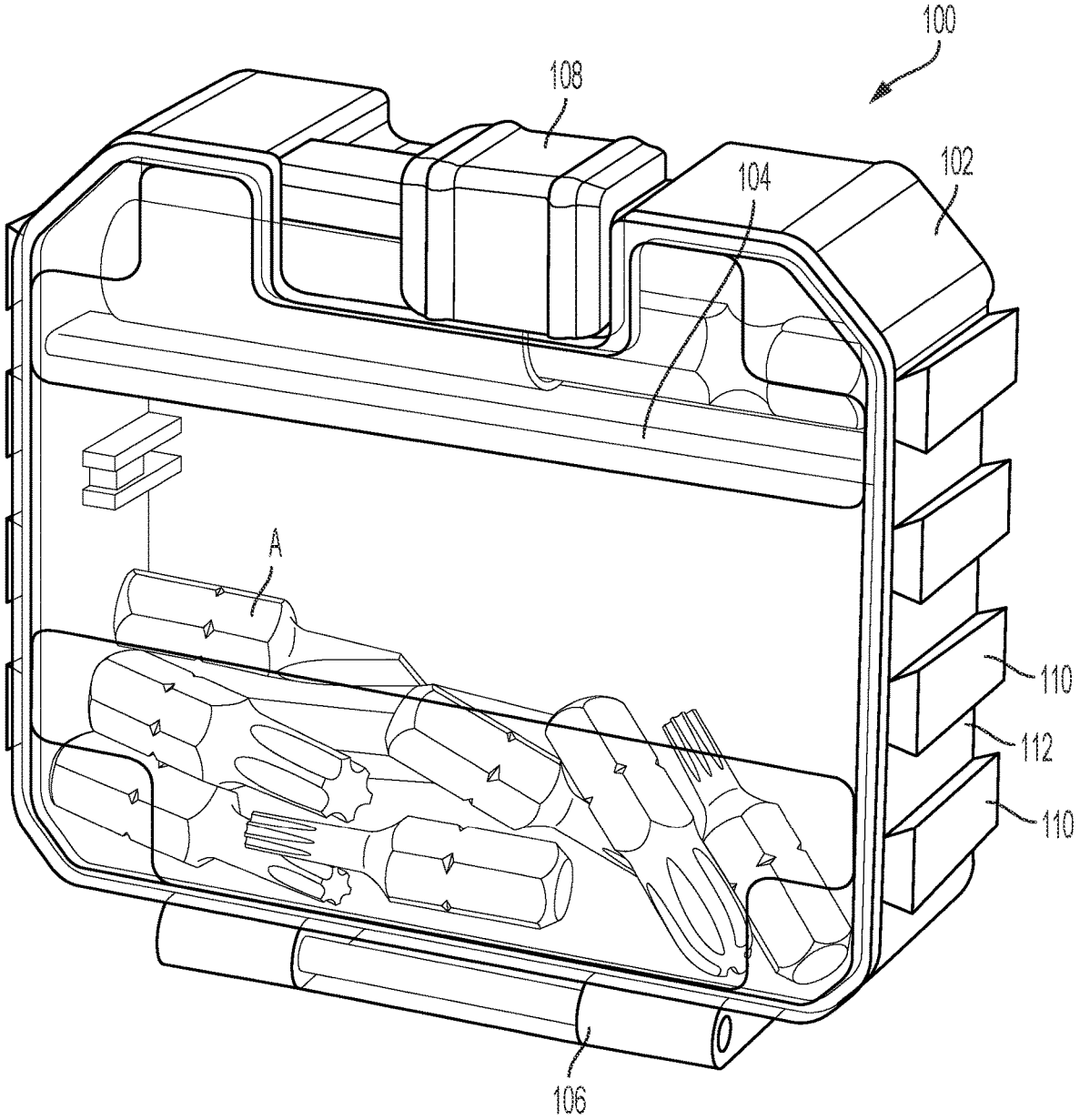
FIG. 1 (Prior Art)
FIG. 1 is a front perspective view of an embodiment of a bulk storage container.

Referring to FIG. 1, a tool container 100 may be configured to contain multiple tool accessories A together in bulk (as opposed to being individually held, spaced apart). The container 100 includes a base 102 and a cover 104 pivotably coupled to the base via a hinge 106 and moveable between an open position and a closed position. In various embodiments, one or more of the base 102 and the cover 104 may be opaque, transparent or translucent. For example, in an embodiment, the base 102 may be opaque, while the cover 104 may be transparent or translucent so that a user may see what is stored within. In some embodiments, parts of the base 102 or the cover 104 may be transparent, while other parts of the base 102 or the cover 104 may be opaque.

A container latch 108 selectively locks the cover 104 in the closed position relative to the base 102. The latch 108 may be slidable between its locked and unlocked positions. Alternatively, the latch 108 may be pivotable. For example, the exterior of one of the base 102 and the cover 104 may carry the latch 108, which may be movable (e.g., pivotably) between a locked position holding the cover 104 and the base 102 together in a closed position, and an unlocked position such that the cover 104 may pivot relative to the base 102 via the hinge 106. The latch 108 carried by one of the base 102 or cover 104 would then include a first locking latch portion (e.g., a rectangular aperture or recess) that is engageable with a first locking member on the other of the base 102 or cover 104 when the latch 108 is in the locked position.

Figure 2:
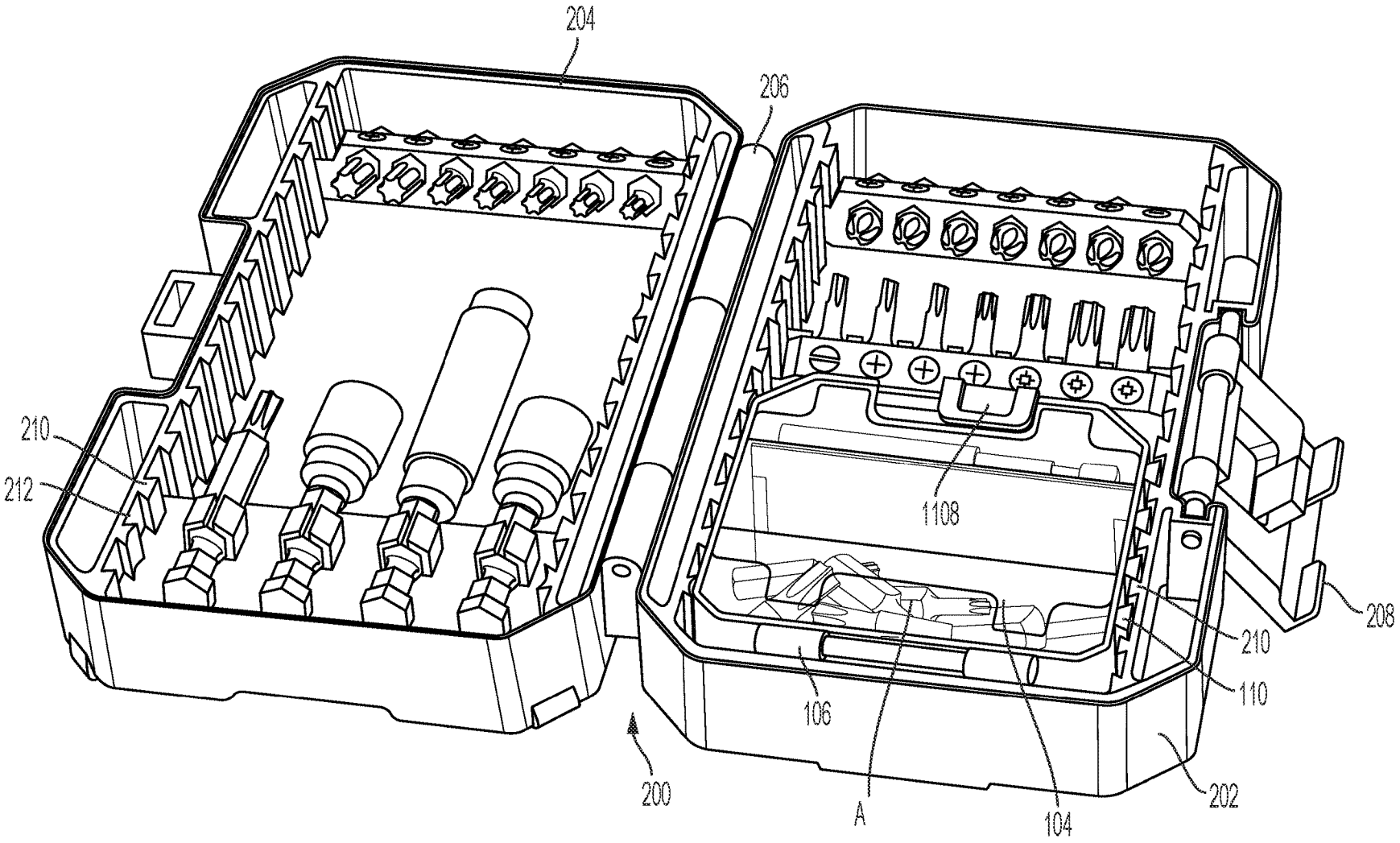
FIG. 2 (Prior Art)
FIG. 2 is a top perspective view of an embodiment of the bulk storage container of FIG. 1 inside another conventional tool or tool accessory container.
Figure 3:
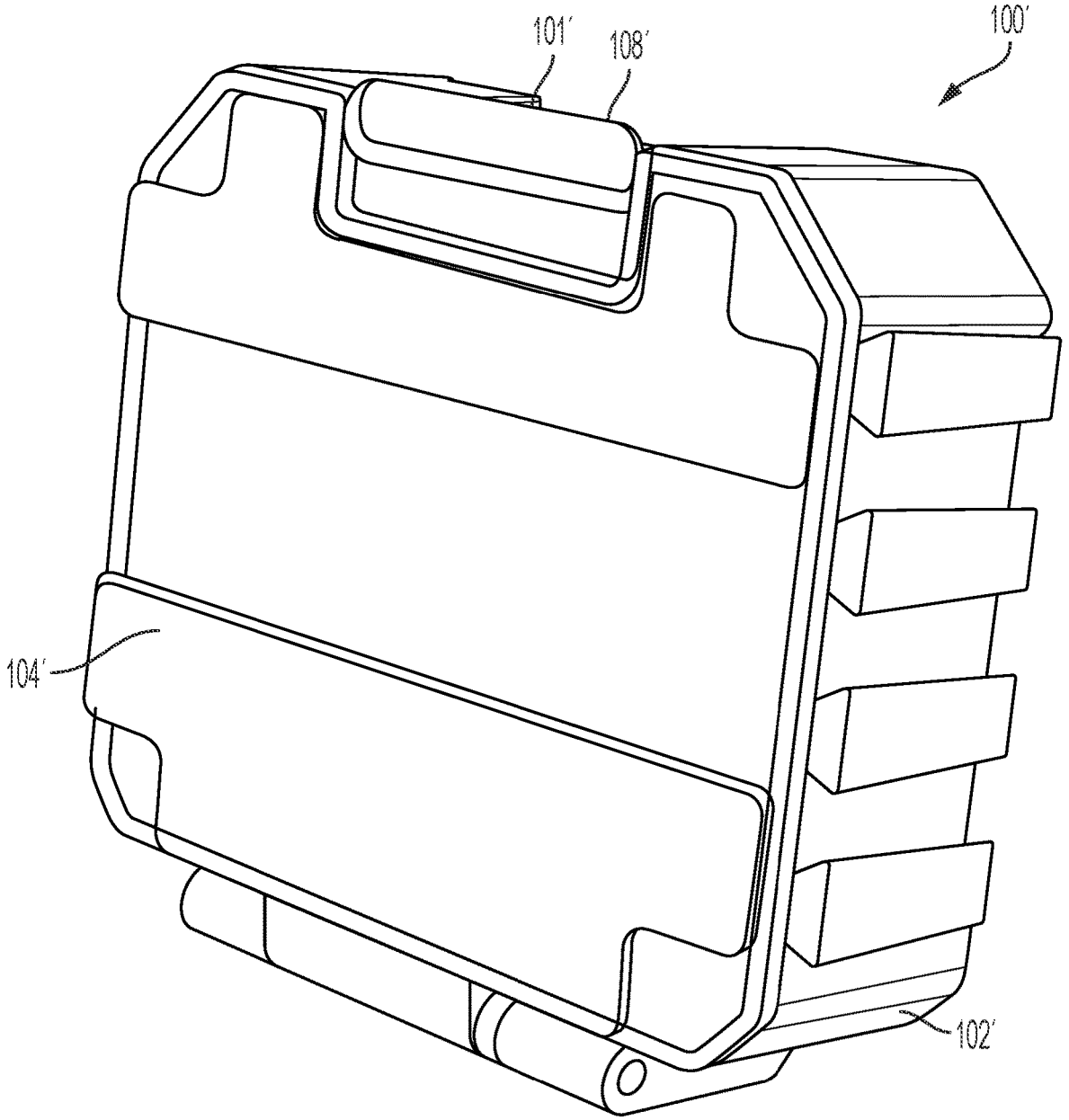
FIG. 3 (Prior Art)
FIG. 3 is a front perspective view of another embodiment of a conventional bulk storage container.

It may be appreciated that the container 100 may include exterior oriented projections 110 and recesses 112 that may facilitate securing the container 100 into a larger storage assembly, such as is shown in FIG. 2. While other engagement shapes may be possible in other embodiments, in the illustrated embodiment, the projections 110 are dovetail projections. As further shown in FIG. 2, a container 200 may include its own base 202 with its own cover 204, which may be secured together by a hinge 206, and selectively retained in a closed position through a latch 208. It may be appreciated that one or more of the base 202 and the cover 204 may have their own interior oriented projections 210 and recesses 212. Accordingly, the container 100 may be stored inside the container 200 by inserting the container 100 so that the projections 110 fit into the recesses 212, and the projections 210 fit into the recesses 112. In some embodiments, the latch 108 and hinge 106 may be configured such that the latch 108 may be actuated and the cover 104 may be opened relative to the base 102 without removing the container 100 from the container 200.

The container 100 described herein is not limiting to the containers applicable to the invention disclosed herein. For example, FIG. 3. Illustrates a container 100' having substantially the same design as container 100, with the following differences. The container 100' has a latch 108' comprised of a lip 101' on the cover 104' that engages a recess (not shown) on the base 102' to lock the cover 104' to the base 102' in a closed position. Additionally, as shown, in an embodiment the cover 104' may be opaque instead of transparent.

The storage containers 100, 100' may have dimensions enabling them to fit inside either one of the bases 202 or covers 204 of the container 200 or other such containers. The containers 100, 100' each may include exterior interlocking elements (e.g., projections and recesses 110, 112) that can engage cooperating interior interlocking elements (e.g., projections and recesses 210, 212) of the container 200, and may removably but securely retain the storage containers 100, 100' in one of a plurality of positions inside the tool containers 200 or similar such containers. The exterior interlocking elements 110, 112 may be positioned, e.g., on opposite exterior sides of the storage containers 100, 100', and the interior interlocking elements 210, 212 may be positioned on interior sides of containers 200 or similar such containers. These interior and exterior interlocking elements can each comprise a protrusion, a recess, or both. For example, the exterior interlocking elements on the containers 100, 100' may include alternating dovetail projections and recesses that can engage the dovetail projections and recesses on the interior walls of the containers 200. This enables the containers 100, 100' to be removably retained in one of the containers 200 and may further enable the covers 104, 104' of the storage containers 100, 100' to be opened while they are retained in one of the containers 200.

Figure 4:
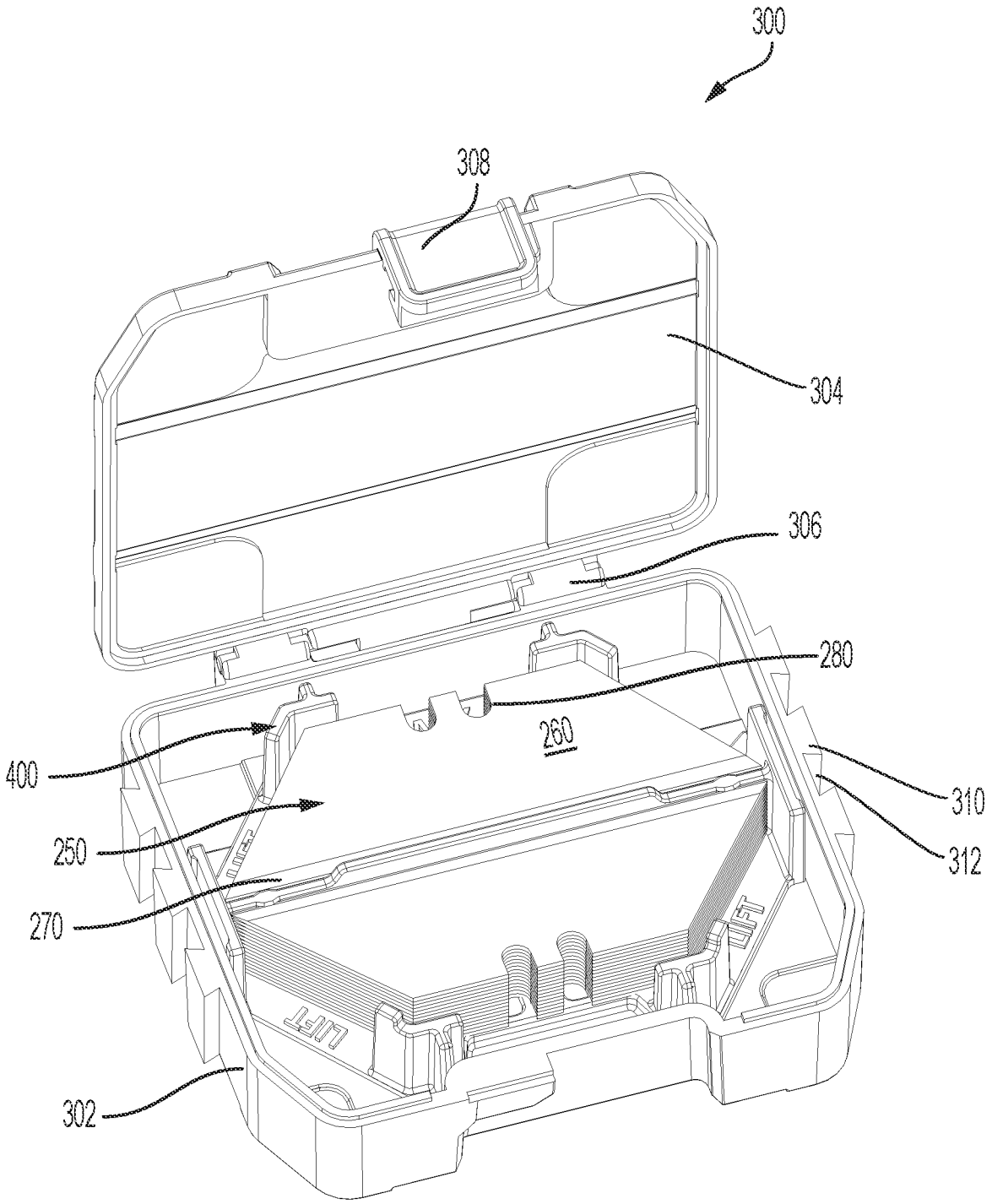
FIG. 4 is a perspective view of a storage container configured to hold utility knife blades therein.

It may be appreciated that bulk storage containers like those shown in FIGS. 1-3 may be appropriate for items such as screwdriver bits, but may be unsuitable for storage of sharp instruments like utility knife blades, such as blades 250 shown in FIG. 4, as such instruments are more likely to cause injury upon contact if shifted during storage. It may be appreciated that conventional utility knife blades 250 include a planar body 260 with a sharpened edge 270, and may include one or more mounting features 280 that are used to retain the blade 250 in a utility knife. Such blades may commonly be of an isosceles trapezoid configuration, with the mounting feature 280 opposite the sharpened edge. Other utility knife blades may include mounting feature(s) 280 located to the interior of the planar body 260, may include a sharpened hook configuration, rounded points, or have other conventional configurations that generally approximate an isosceles trapezoid in expanse. It may be appreciated that the teachings herein may also be applicable to so called "snap knife" utility knife blades, which typically are elongated to include a plurality of connected blade segments with a mounting feature at one side, so that the blade may be extended from the knife, and blade segments may be broken off to expose previously unused sharpened points and portions of the blade.

Regardless, FIG. 4 shows a perspective view of a storage container 300 configured to hold utility knife blades 250 therein. As shown, the container 300 may include a base 302 with a cover 304, which may be pivotally secured together by a hinge 306, and selectively retained in a closed position through a latch 308. The latch 308 in the illustrated embodiment is depicted as similar to latch 108 and as such may be slidable along the base 302 and the cover 304 to decouple the base 302 from the cover 304 thereat, so that the cover 304 may pivot relative to the base 302 at the hinge 306. In other embodiments the latch 308 may be configured similarly to latch 108', where the latch 308 would be carried on one of the base 302 and the cover 304, and pivot relative to the other of the base 302 and the cover 304 to hold the base 302 to the cover 304.

In various embodiments, one or more of the base 302 and the cover 304 may have exterior oriented projections 310 and recesses 312, such as those shown on the base 302 of FIG. 4. Accordingly, the container 300 may be stored inside containers such as the container 200 by inserting the container 300 so that the projections 310 fit into the recesses 212, and the projections 210 fit into the recesses 312. In some embodiments, the latch 308 and hinge 306 may be configured such that the latch 308 may be actuated and the cover 304 may be opened relative to the base 302 without removing the container 300 from the container 200.

To keep the blades 250 positioned appropriately within the container 300 so that they do not slide around during transport, the container 300 may include a shaped blade retainer 400, described in greater detail below. It may be appreciated that the blade retainer 400 may be configured to generally keep the sharpened edge 270 of the blades 250 oriented in a same direction. While in the illustrated embodiment, with reference to FIG. 5, the shaped blade retainer 400 may be removable from the container 300, in other embodiments the blade retainer 400 may be integrally formed or permanently attached to the container 300, or may otherwise contain features described herein as part of the container 300 fixedly coupled or formed thereto which allows the retainer 400 to be received in the container 300 or the container 200 as described herein.

As an example, in some embodiments, interior oriented projections or recesses similar to projections 210 and recesses 212 may be arranged inside the container 300, which may facilitate engagement with the removable blade retainer 400, to the extent that the retainer 400 includes exterior oriented projections or recesses shaped to engage the interior oriented projections or recesses of the container 300. Similarly, it may be appreciated that such exterior oriented features of the retainer may facilitate the retainer 400 being received in containers such as the container 200 directly.

Figure 5:
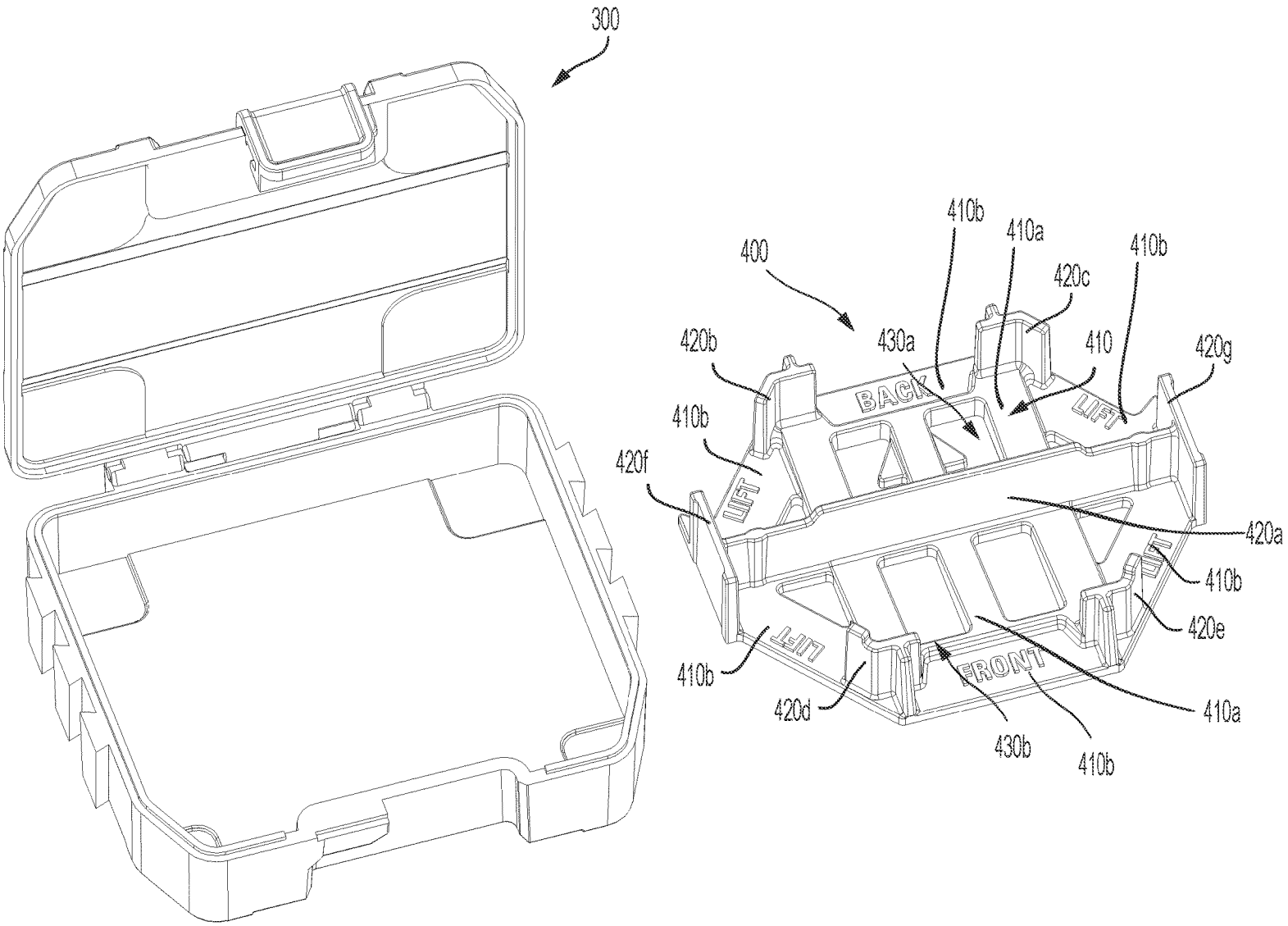
FIG. 5 is a top perspective view of the storage container of FIG. 4, with a blade retainer separated therefrom.
Figure 6:
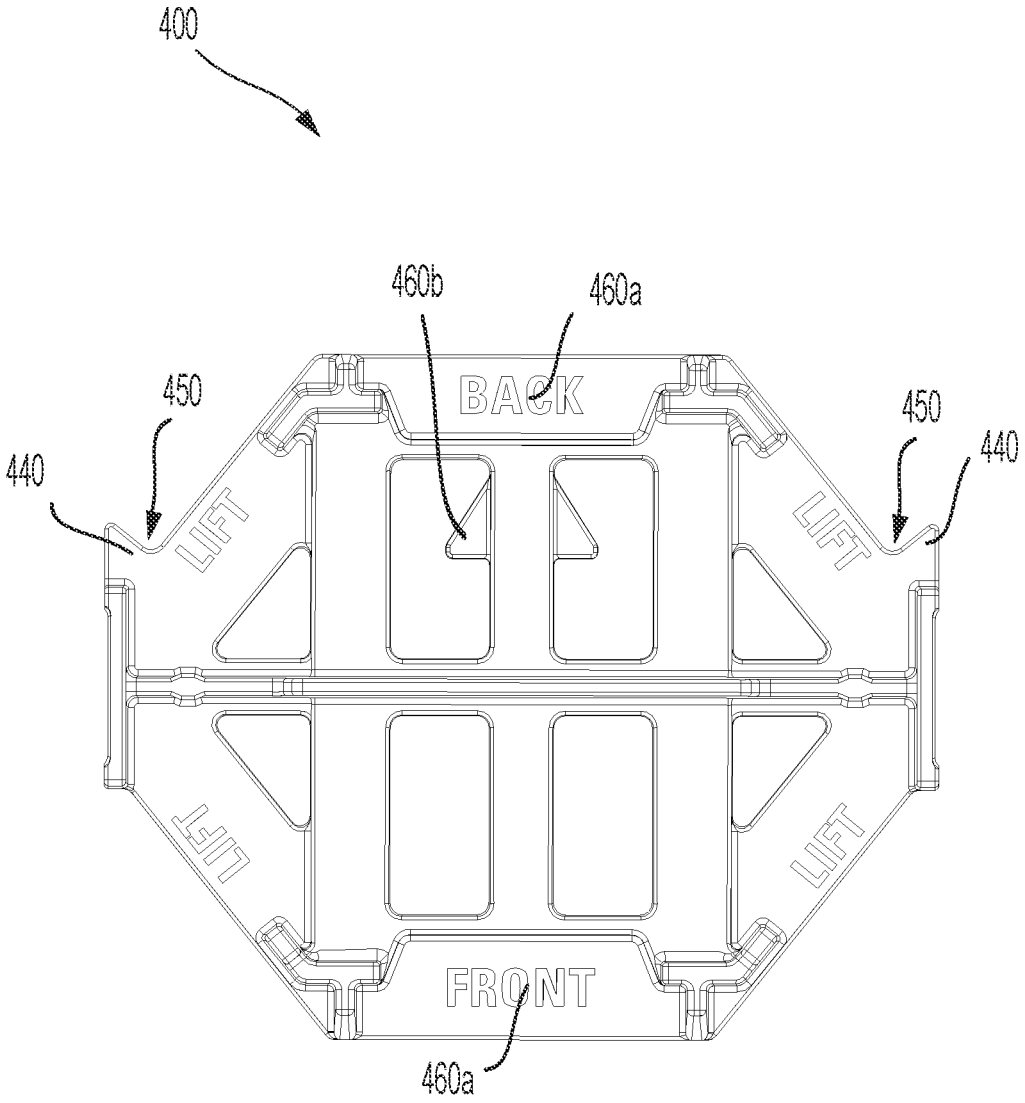
FIG. 6 is a top view of the blade retainer.

An embodiment of the blade retainer 400 is descried with reference to the top perspective view shown in FIG. 5, and the top view of the blade holding insert shown in FIG. 6. As shown, in an embodiment the blade retainer 400 may include a body portion 410 which may be generally flat to provide connective support for transversely extending protrusions (e.g. protrusions 420*a-f* in the illustrated embodiment, generically protrusions 420) that extend therefrom. It may be appreciated that the body portion 410 may be integral to the container when the retainer 400 is fixed thereto. In embodiments where the retainer is removable from a container, the body portion 410 may couple the protrusions 420 so that the retainer 400 as a whole may be removed from the container, and similarly may be used to lift a stack of blades 250 from the container as well.

As shown, in an embodiment the protrusions 420 may be configured so as to surround a stack of blades 250 so as to prevent their movement relative to each other while the container (e.g., container 300 in FIG. 5) is being transported. The illustrated embodiment shows that in some embodiments the retainer 400 may be configured to hold multiple stacks of blades 250. As such, the illustrated retainer 400 includes a first blade section 430*a* and a second blade section 430*b*. In an embodiment, a protrusion 420*a* may be associated with the sharpened edges 270 of the blades 250. In the illustrated embodiment including the first blade section 430*a* and the second blade section 430*b*, a protrusion 420*a* may be a central protrusion that is positioned to contact both the sharpened edges 270 of the blades 250 in the first blade section 430*a* and the sharpened edges 270 of the blades 250 in the second blade section 430*b*. In an embodiment, protrusions such as 420*b*, 420*c*, 420*d*, and 420*e* may be configured to define a generally trapezoidal shape and contact multiple faces of the trapezoidal shape of the blades 250, by extending around corners of the blades 250. As such, where positioned opposite the protrusion 420*a*, protrusions 420*b* and 420*c* (and protrusions 420*d* and 420*e* when the retainer 400 is configured to hold additional blades 250 in a second blade section 430*b*) may prevent both side-to-side movement of the blades 250, as well as movement of the blades 250 away from the protrusion 420*a*.

Other configurations of the protrusions 420 may further or alternatively limit movement of the blades 250. For example, in the illustrated embodiment of the retainer 400, side protrusions 420*f* and 420*g* are further configured to limit or prevent side-to-side movement of the blades 250. In the illustrated embodiment, the protrusions 420*f* and 420*g* extend on either side of the shared protrusion 420*a*, forming a common i-beam (e.g., capital letter I with crossbars) shape that prevents side to side movement of blades 250 in both the first blade section 430*a* and the second blade section 430*b*. It may be appreciated that any appropriate configuration of protrusions 420 may be utilized in various embodiments to limit side to side movement of the blades 250 or movement of the blades 250 away from the protrusion 420*a* positioned adjacent to the sharpened edge 270 of the blade 250. Likewise, in some embodiments, some protrusions such as 420*b* and 420*c* may be shaped to prevent both side to side movement of the blades 250 and movement of the blades 250 away from the protrusion 420*a*.

In an embodiment the body portion 410 of the retainer 400 may include a relatively protruded region 410*a* that is raised slightly above one or more relatively recessed regions 410*b* that is positioned below edges (e.g., non-sharpened edges) of the blade 250. Accordingly, even a bottommost blade 250 in a stack of blades may have a space maintained underneath part of the blade 250 to facilitate grasping and removing the blade 250 from the retainer 400. As shown, in some embodiments the protruded region 410*a* is formed as a tapered or ramped protrusion, such that the sharpened edge 270 of the blade 250 is not lifted by the relatively protruded region 410*a* by a same amount as the non-sharpened edges surrounding the planar body 260 are.

Turning to FIG. 6, showing a top view of the retainer 400, it may be appreciated that where the container 300 is configured with indexing features therein, the retainer 400 may include features or indicia therein configured to identify alignment with the indexing features in the container 300. As such, in the embodiment shown, retainer 400 includes indexing protrusions 440 and indexing recesses 450, which may block insertion of the retainer 400 into inappropriate containers 300. It may be appreciated that such indexing features 440 or 450 may also facilitate holding the retainer 400 in a larger container.

In the illustrated embodiment the retainer 400 also includes alignment indicia such as text-based indicia 460*a* (e.g. indicating which sides of the retainer 400 should face a front or back of the container 300 when inserted therein) and graphical indicia 460*b* (e.g., an indicator arrow). It may be appreciated that the text-based indicia 460*a* and the graphical indicia 460*b* may each be molded into the retainer 400 or applied to the retainer 400. In some embodiments, the indicia may be formed into the shape of parts of the retainer 400, such as the arrow configuration of the graphical indicia 460*b*. Combinations of one or more of such indexing features or alignment indicia may be utilized in various embodiments, which may be configured to create an asymmetrical appearance to the retainer 400.

Figure 7:
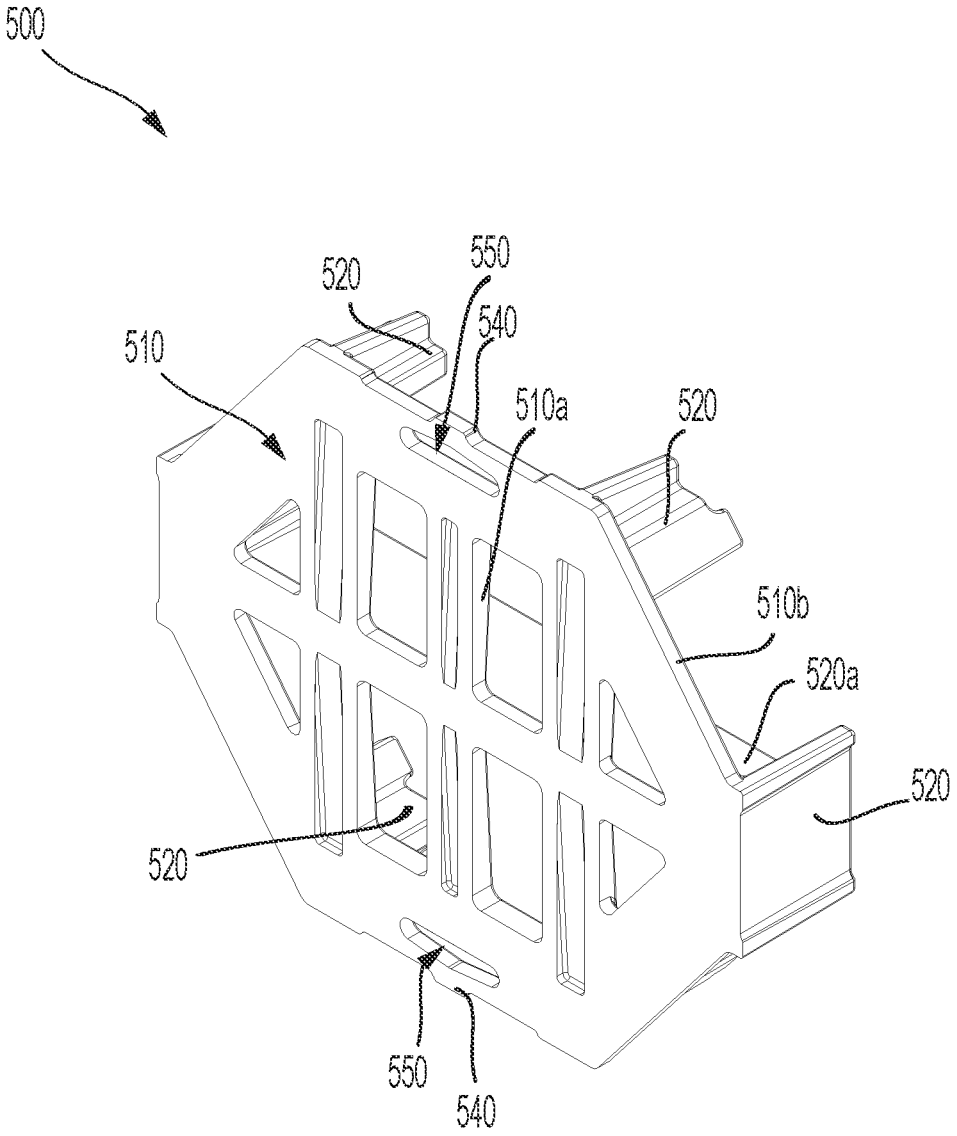
FIG. 7 is a rear perspective view of another embodiment of a blade retainer.
Figure 8:
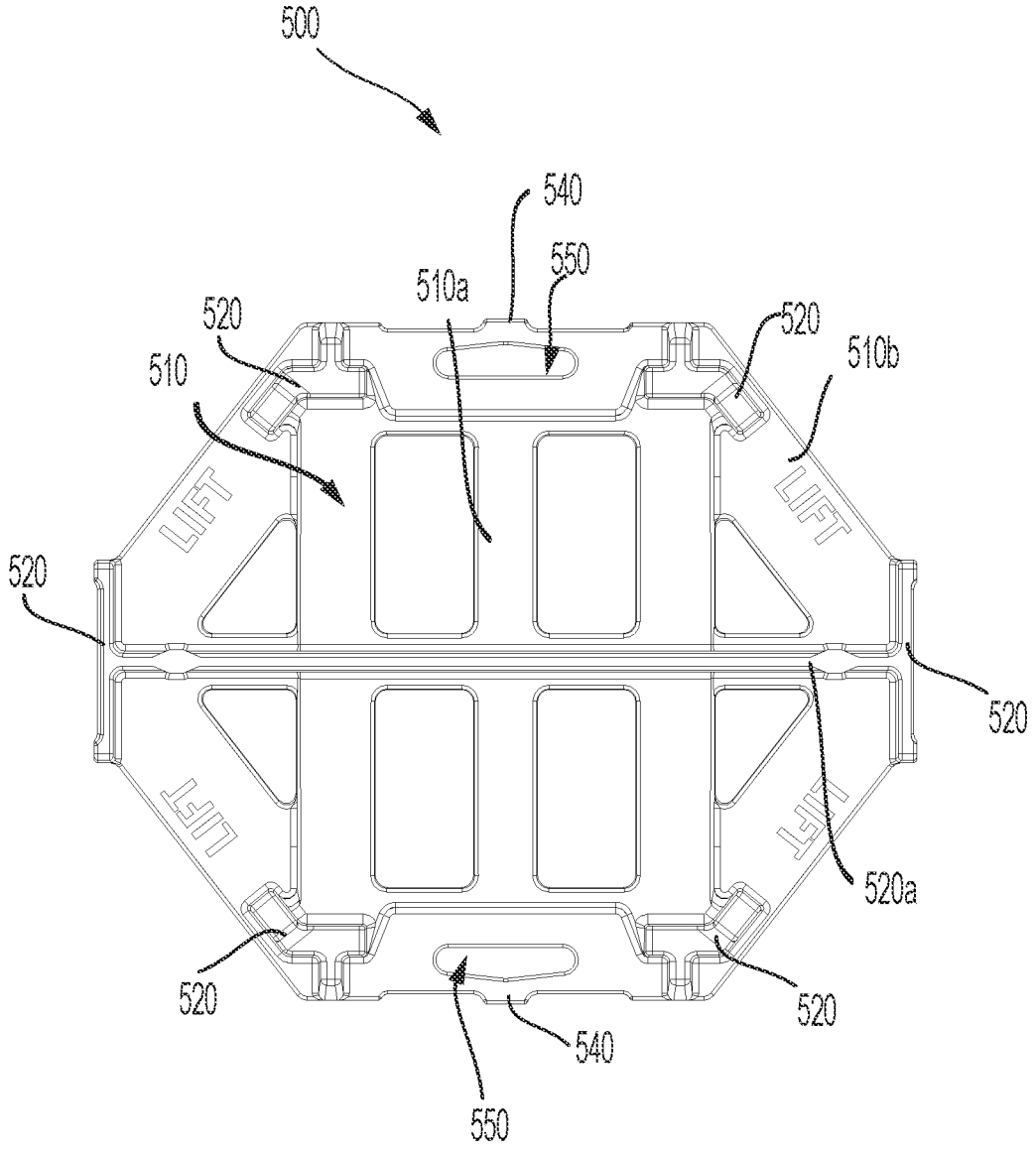
FIG. 8 is a top view of the blade retainer of FIG. 7.

FIG. 7 and FIG. 8 illustrate a retainer 500 that is generally similar to the retainer 400 except as otherwise discussed herein. For example, blade retainer 500 includes a body portion 510 which may be configured similarly to body portion 410, with relatively protruded regions 510*a*, similar to relatively protruded regions 410*a*, that extend further from the body portion 510 than relatively recessed regions 510*b*, similar to relatively recessed regions 410*b*, to hold portions of the blades 250 received therein (e.g., one or more non-sharpened edges thereof) slightly above the body portion 510 to facilitate lifting the blades 250 thereat for removal of blades 250 from the retainer 500. The protrusions 520 retaining the blades 250 to prevent side to side movement and/or movement away from a protrusion 520*a* associated with the sharpened edge 270 may be generally similar to the protrusions 420 (e.g., protrusions 420*a-f*) as described above.

As further shown, the retainer 500 may include one or more container engaging detents 540 that protrude slightly from the body portion 510 (or from the protrusions 520, and/or other regions of the retainer 500 in various embodiments), to provide an alternative engagement with the container 300 or other such containers. It may be appreciated that the container engaging detents 540 may flex to provide a friction or spring-biased securing fit between the retainer 500 and the container 300 or other such container. In an embodiment, the detent 540 may be positioned adjacent to an aperture 550, such that the detent 540 may be compressed into the aperture 550 by walls of the container 300 when the retainer 500 is placed in the container 300. Resiliency of the material of the retainer 500 and/or a spring force (e.g., applied by a spring if not intrinsic to the material of the retainer 500) as the detent 540 seeks to return to its original position relative to the aperture 550 may thus provide a force between the retainer 500 and the container 300, helping to secure the retainer 500 within the container 300.

While the illustrated embodiment of the retainer 500 is symmetrical, it may be appreciated that other configurations of retainers according to the present disclosure may not be. Regardless, it may be appreciated that various configurations of retainers such as retainers 400 and 500 may be configured as inserts to engage with desired storage containers of appropriate size, to convert bulk storage containers, or containers configured to receive removable bit inserts so that they may hold blades 250. While in some embodiments the retainers may be formed of plastic, other materials may be utilized instead or in addition in the construction of such retainers. For example, as noted above, the detent 540 may be formed as spring biased, where such spring may be integral to the resiliency of the material of the detent 540, or may be formed with combinations of a metal spring (coil or leaf) for additional support. In some embodiments, the entirety of the retainer may be formed as a single piece of molded plastic (e.g., injection molded) while in other embodiments the retainer may be formed as an assembly of different components that may be coupled together by adhesives, mechanical fasteners, interlocking or snap fitting components, or so on.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments have been provided so that this disclosure will be thorough, and to fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Terms of degree such as "generally," "substantially," "approximately," and "about" may be used herein when describing the relative positions, sizes, dimensions, or values of various elements, components, regions, layers and/or sections. These terms mean that such relative positions, sizes, dimensions, or values are within the defined range or comparison (e.g., equal or close to equal) with sufficient precision as would be understood by one of ordinary skill in the art in the context of the various elements, components, regions, layers and/or sections being described.

Numerous modifications may be made to the exemplary implementations described above. These and other implementations are within the scope of the following claims.

What is claimed is:

1. A tool container system comprising:

a tool container having a base, a cover pivotably attached to the base by a hinge portion, and a latch coupled to the base and moveable between an unlatched position in which the cover is movable relative to the base between a closed position and an open position, and a latched position in which the latch engages the cover, locking the cover to the base in the closed position; and a utility knife blade retainer configured to be received in and held by the tool container, the utility knife blade retainer configured to define a generally trapezoidal shape and contact multiple faces of a trapezoidal shape of utility knife blades received in the utility knife blade retainer; and wherein the utility knife blade retainer comprises an engagement protrusion or recess configured to engage with the tool container comprising a corresponding protrusion or recess to limit movement of the utility knife blade retainer within the tool container;

wherein the utility knife blade retainer comprises a body portion having a relatively protruded region raised above a relatively recessed region positioned below a non-sharpened edge of a blade received in the utility knife blade retainer to maintain a space underneath the non-sharpened edge of the blade to facilitate grasping and removing the blade from the utility knife blade retainer.

2. The tool container system of claim 1, wherein the engagement protrusion or recess is a protrusion comprises a detent configured to move relative to a body portion of the utility knife blade retainer so as to provide a securing fit between the utility knife blade retainer and the tool container.

3. The tool container system of claim 2, wherein the body portion comprises an aperture associated with the detent, and wherein the detent is configured to be squeezed by the tool container towards the aperture, such that a restorative force is exerted against the tool container.

4. The tool container system of claim 2, wherein the detent is integrally formed with the body portion of the utility knife blade retainer.

5. The tool container system of claim 1, wherein the tool container comprises exterior oriented projections and recesses shaped to engage interior oriented projections and recesses of a larger storage assembly.

6. The tool container system of claim 1, wherein the utility knife blade retainer is tapered so a sharpened edge of the blade is raised less than the non-sharpened edge of the blade.

7. The tool container system of claim 1, wherein the utility knife blade retainer is shaped to define a plurality of generally trapezoidal shapes to retain a plurality of stacks of utility knife blades received in the utility knife blade retainer.

8. The tool container system of claim 1, wherein a plurality of protrusions of the utility knife blade retainer together define the generally trapezoidal shape within the protrusions to limit side to side movement of the utility knife blades and movement of the utility knife blades away from a protrusion positioned adjacent to a sharpened edge of utility knife blades received in the utility knife blade retainer.

9. The tool container system of claim 8, wherein one of the plurality of protrusions is shaped to limit both side-to-side movement of the utility knife blades and movement of the utility knife blades away from the protrusion positioned adjacent to the sharpened edge of utility knife blades.

10. A utility knife blade retainer configured to be received in and held by a tool container, the utility knife blade retainer comprising:

a generally trapezoidal shape defined in the utility knife blade retainer configured to contact multiple faces of a trapezoidal shape of utility knife blades received in the utility knife blade retainer;

an engagement protrusion or recess configured to engage with the tool container to limit movement of the utility knife blade retainer within the tool container;

wherein the utility knife blade retainer comprises a body portion having a relatively protruded region raised above a relatively recessed region positioned below a non-sharpened edge of a blade received in the utility knife blade retainer to maintain a space underneath the non-sharpened edge of the blade to facilitate grasping and removing the blade from the utility knife blade retainer.

11. The utility knife blade retainer of claim 10, wherein the engagement protrusion or recess is a protrusion comprises a detent configured to move relative to a body portion of the utility knife blade retainer so as to provide a securing fit between the utility knife blade retainer and the tool container.

12. The utility knife blade retainer of claim 11, wherein the body portion comprises an aperture associated with the detent, and wherein the detent is configured to be squeezed by the tool container towards the aperture, such that a restorative force is exerted against the tool container.

13. The utility knife blade retainer of claim 11, wherein the detent is integrally formed with the body portion of the utility knife blade retainer.

14. The utility knife blade retainer of claim 10, wherein the utility knife blade retainer is tapered so a sharpened edge of the blade is raised less than the non-sharpened edge of the blade.

15. The utility knife blade retainer of claim 10, wherein the utility knife blade retainer is shaped to define a plurality of generally trapezoidal shapes to retain a plurality of stacks of utility knife blades received in the utility knife blade retainer.

16. A tool container system comprising:

a tool container having a base, a cover pivotably attached to the base by a hinge portion, and a latch coupled to the base and moveable between an unlatched position in which the cover is movable relative to the base between a closed position and an open position, and a latched position in which the latch engages the cover, locking the cover to the base in the closed position; and a utility knife blade retainer configured to be received in and held by the tool container, the utility knife blade retainer configured to define a generally trapezoidal shape and contact multiple faces of a trapezoidal shape of utility knife blades received in the utility knife blade retainer; and wherein the utility knife blade retainer comprises a means for engaging with the tool container to limit movement of the utility knife blade retainer within the tool container;

wherein the utility knife blade retainer comprises a body portion having a relatively protruded region raised above a relatively recessed region positioned below a non-sharpened edge of a blade received in the utility knife blade retainer to maintain a space underneath the non-sharpened edge of the blade to facilitate grasping and removing the blade from the utility knife blade retainer.

* * * * *